US008696170B2

(12) United States Patent
Huang

(10) Patent No.: US 8,696,170 B2
(45) Date of Patent: Apr. 15, 2014

(54) ILLUMINATING DEVICE

(75) Inventor: Ming-Chih Huang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 64 days.

(21) Appl. No.: 13/615,684

(22) Filed: Sep. 14, 2012

(65) Prior Publication Data

US 2013/0301260 A1 Nov. 14, 2013

(30) Foreign Application Priority Data

May 10, 2012 (TW) ..... 101116704 A

(51) Int. Cl.
*F21V 29/00* (2006.01)

(52) U.S. Cl.
USPC ..... 362/294; 362/373; 362/249.02

(58) Field of Classification Search
USPC ..... 362/235, 294, 373, 249.02
See application file for complete search history.

(56) References Cited

U.S. PATENT DOCUMENTS 8,033,686 B2 10/2011 Recker et al.
2002/0141190 A1* 10/2002 Matsuba et al. ..... 362/294
2009/0154149 A1* 6/2009 Huang ..... 362/183
2009/0316413 A1* 12/2009 Henry ..... 362/294
2011/0068698 A1 3/2011 Swoboda et al.

FOREIGN PATENT DOCUMENTS

TW M278059 10/2005
TW 201120363 6/2011
TW M416047 11/2011

OTHER PUBLICATIONS

"3M™ EMI/EMC Electronic Materials—Solutions for Today's Electronics," 3M™ EMI/EMC Solutions Brochure, 2011, Retrieved from http://multimedia.3m.com/mws/mediawebserver?mwsId=66666UuZjcFSLXTtnxTynXfEEVuQEcuZgVs6EVs6E666666--, pp. 1-12.

* cited by examiner

*Primary Examiner* — Evan Dzierzynski
(74) *Attorney, Agent, or Firm* — Jianq Chyun IP Office

(57) ABSTRACT

An illuminating device including a lampshade, a capper, a light source circuit board and a power circuit board is provided. The lampshade has a top surface and an accommodating space, the capper is telescoped on the lampshade, and the top surface of the lampshade is located in the capper. The light source circuit board is disposed at the top surface, having a first inductance coil. The power circuit board is disposed in the accommodating space, having a second inductance coil, wherein the first inductance coil and the second inductance coil are disposed adjacent to each other and spaced apart by a distance. In the illuminating device, power of the power circuit board is generated by induced current from the first inductance coil and the second inductance coil and provided to the light source circuit board for light-emitting.

16 Claims, 5 Drawing Sheets

ILLUMINATING DEVICE

CROSS-REFERENCE TO RELATED APPLICATION

This application claims the priority benefit of Taiwan application serial no. 101116704, filed on May 10, 2012. The entirety of the above-mentioned patent application is hereby incorporated by reference herein and made a part of this specification.

BACKGROUND OF THE INVENTION

1. Field of the Invention

The invention relates to an illuminating device, and more particularly to an illuminating device having different structure from conventional illuminating device.

2. Description of Related Art

FIG. 1 is a schematic exploded view illustrating a conventional illuminating device. Referring to FIG. 1, the conventional illuminating device includes a lampshade 10, a light source circuit board 20 disposed in the lampshade 10 and a capper 30 masked on the light-emitting end of the light source circuit board 20. The light source circuit board 20 is formed by disposing a plurality of LED (light emitting diode) monomers 21 on a circuit board 22. Power provided by the power circuit board 23 is required for the LED monomers 21 to emit light. Therefore, the power circuit board 23 and each of the LED monomers 21 are electrically connected by a connecting wire (or a connector) 211, which is disposed between the light source circuit board 20 and the power circuit board 23 by soldering or wiring manually.

However, the purpose of using the circuit board 22 is not only for mounting each LED monomer 21 on the same plane, but also allowing effective heat dissipation for the LED monomer 21. The power circuit board 23 may generate high temperature easily which affects lifetime of the illuminating device. Therefore, high temperature may cause the connecting wire 211 to have problems such as embrittlement, meltdown, bad heat dissipation, contact failure and loosening.

Moreover, in order to connect the connecting wire 211 between the light source circuit board 20 and the power circuit board 23, it is necessary to have apertures disposed on the lampshade 10 for the connecting wire 211 to pass through.

SUMMARY OF THE INVENTION

The invention provides an illuminating device, in which a light source circuit board and a power circuit board are electrically connected without using a connecting wire.

The invention provides an illuminating device, including a lampshade, a capper, a light source circuit board and a power circuit board. The lampshade has a top surface and an accommodating space. The capper is telescoped on the lampshade, and the top surface of the lampshade is located within the capper. The light source circuit board is disposed at the top surface, having a first inductance coil. The power circuit board is disposed in the accommodating space, having a second inductance coil, wherein the first inductance coil and the second inductance coil are disposed adjacent to each other and spaced apart by a distance.

In the illuminating device according to an embodiment of the invention, the lampshade includes a covering piece, a radiator and a screw base. The covering piece has the accommodating space. The radiator and the screw base are respectively telescoped on two ends of the covering piece. The radiator is disposed on one end of the covering piece relatively closer to the lampshade, wherein the power circuit board is accommodated in the covering piece, and the top surface is disposed on the radiator. In addition, the illuminating device may further include a first rubber ring, disposed between the radiator and the covering piece. Moreover, the illuminating device may further include a second rubber ring, disposed between the covering piece and the screw base.

In the illuminating device according to an embodiment of the invention, the light source circuit board includes a first circuit board, a plurality of light sources and the first inductance coil. The first circuit board is disposed at the top surface, and the first circuit board has a first surface relatively far from the top surface. The light sources and the first inductance coil are disposed on the first surface, and the first inductance coil is electrically connected to the light sources through the first circuit board. The first inductance coil is fixed on the first circuit by adapting surface mount technology. In addition, the light sources are LEDs. Further, the light source circuit board may further include a diode, disposed on the first circuit board, and the diode is electrically connected between the first inductance coil and the light sources.

In the illuminating device according to an embodiment of the invention, the power circuit board includes a second circuit board and the second inductance coil disposed on the second circuit board, the second inductance coil is electrically connected to the second circuit board, wherein the first inductance coil and the second inductance coil are located on opposite sides of the top surface. The second inductance coil is a dual inline packages component.

In the illuminating device according to an embodiment of the invention, axial directions of the first inductance coil and the second inductance coil are parallel to normal direction of the top surface.

The illuminating device according to an embodiment of the invention further includes a flux field directional component, disposed between the light source circuit board and the top surface of the lampshade. In addition, the illuminating device further includes a radiating pad, disposed between the flux field directional component and the top surface.

The illuminating device according to an embodiment of the invention further includes a radiating pad, disposed between the light source circuit board and the top surface of the lampshade.

The illuminating device according to an embodiment of the invention further includes a radiating fluid, disposed in the accommodating space.

In the illuminating device according to an embodiment of the invention, brightness of the illuminating device varies with adjustment of a distance between the first inductance coil and the second inductance coil.

Based on the above, in the illuminating device of the invention, inductance coils are respectively disposed between the power circuit board and the light source circuit board, and thus power generated by induced current from two inductance coils is provided to the light source circuit board for light sources to emit light. Compared with conventional illuminating device, in which a connecting wire or a connector is required between the power circuit board and the light source circuit board for transmitting electricity, the illuminating device of the invention transmits electricity without using a connecting wire or a connector between the power circuit board and light source circuit board.

To make the aforementioned and other features and advantages of the invention more comprehensible, several embodiments accompanied with figures are described in detail below.

DESCRIPTION OF THE EMBODIMENTS

Figure 1:
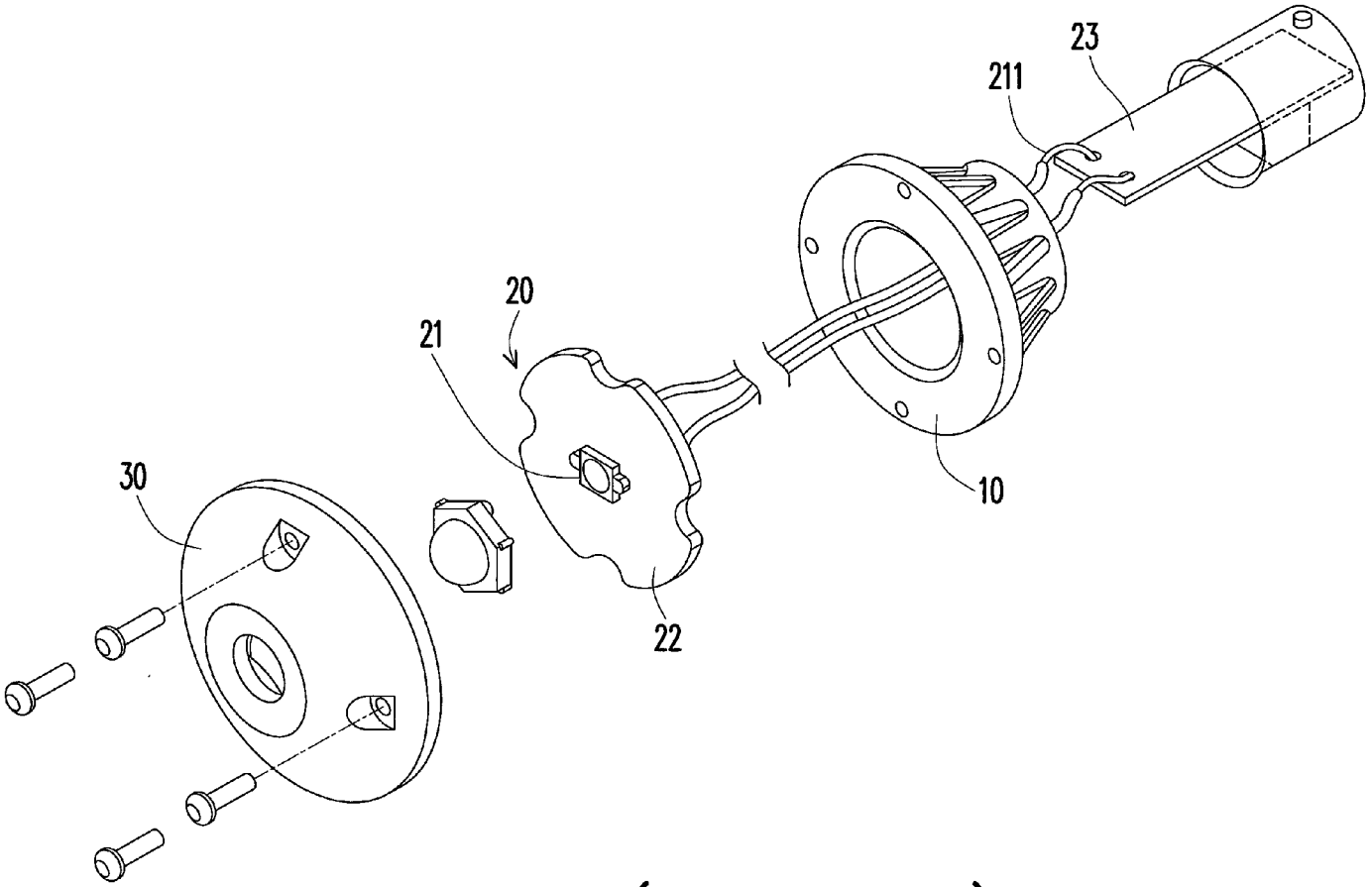
FIG. 1 (RELATED ART)
FIG. 1 is a schematic exploded view illustrating a conventional illuminating device.
Figure 2:
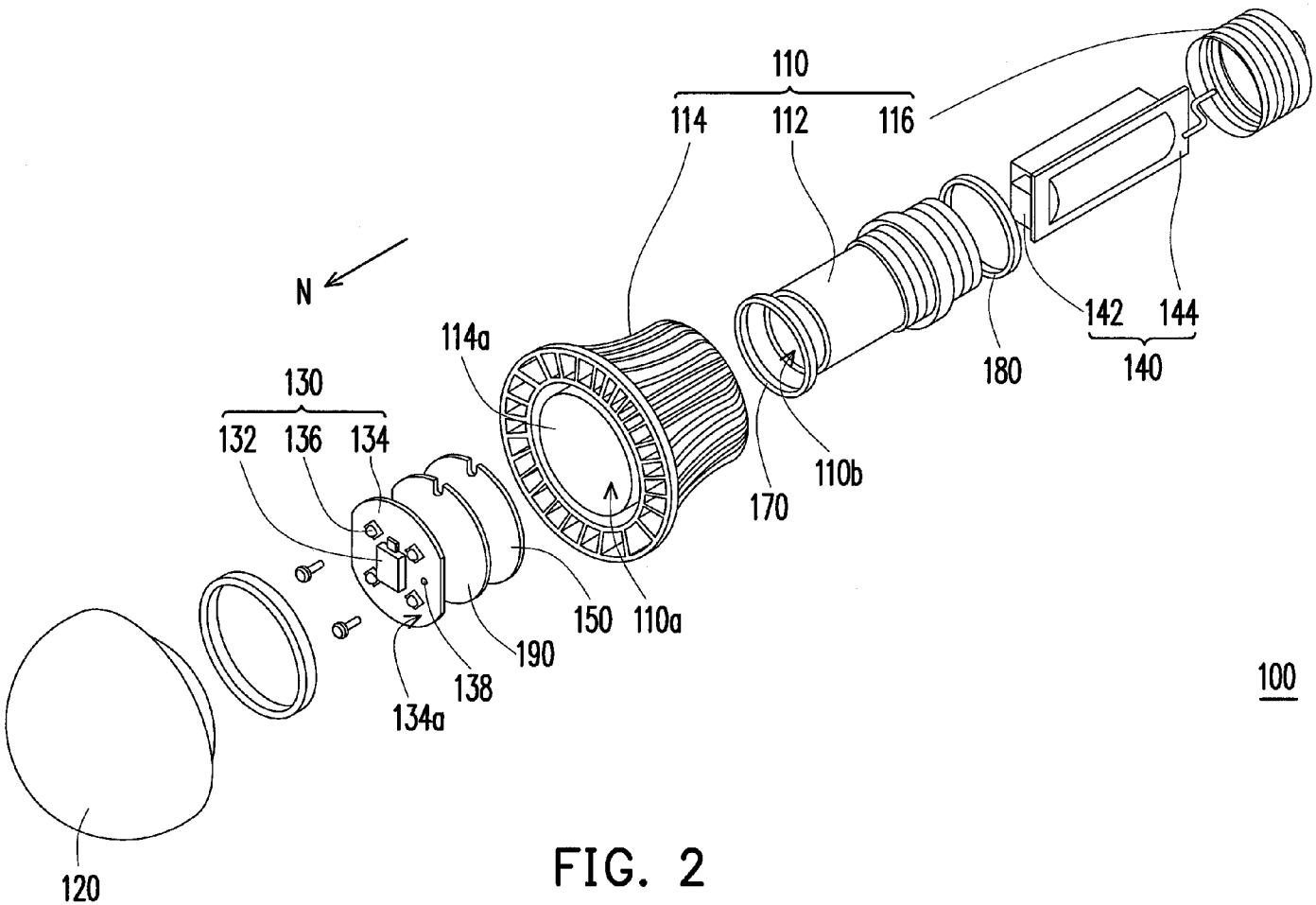
FIG. 2 is a schematic exploded view illustrating an illuminating device according to an embodiment of the invention.
Figure 3:
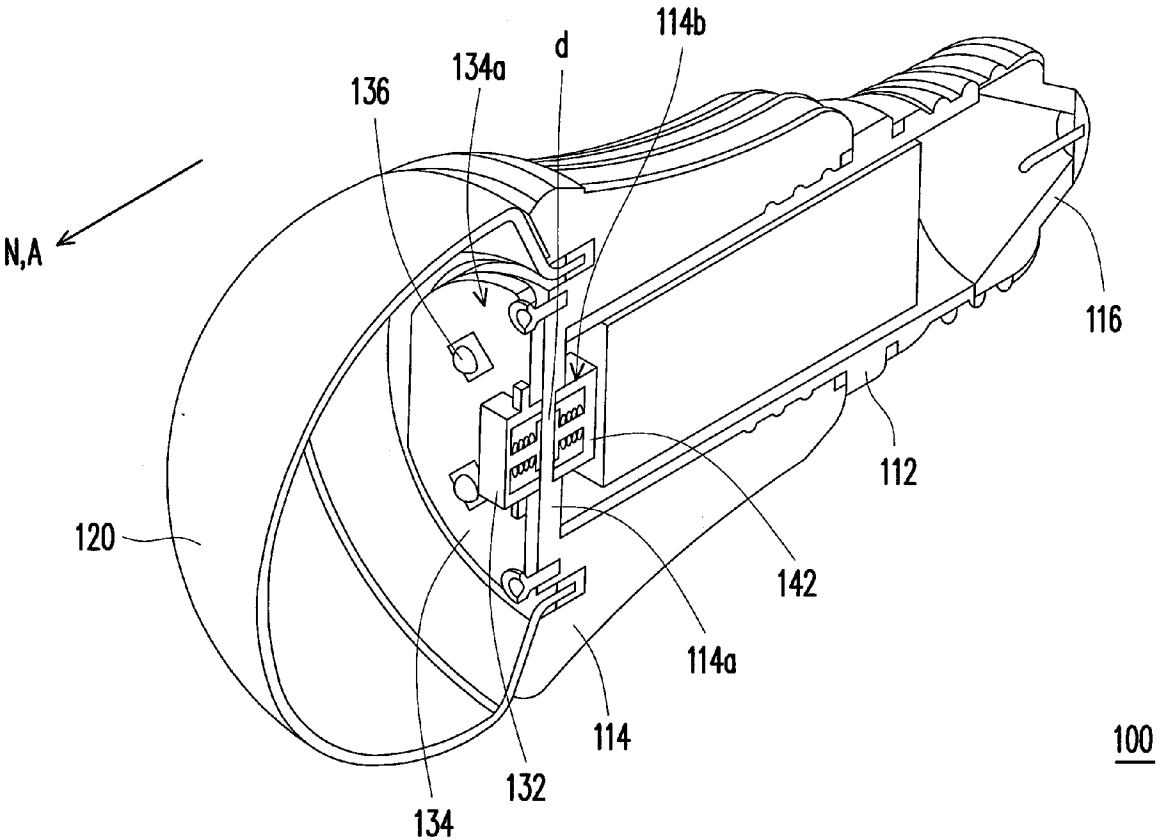
FIG. 3 is a cross-sectional view in three-dimension illustrating the illuminating device of FIG. 2 after assembly.
Figure 4:
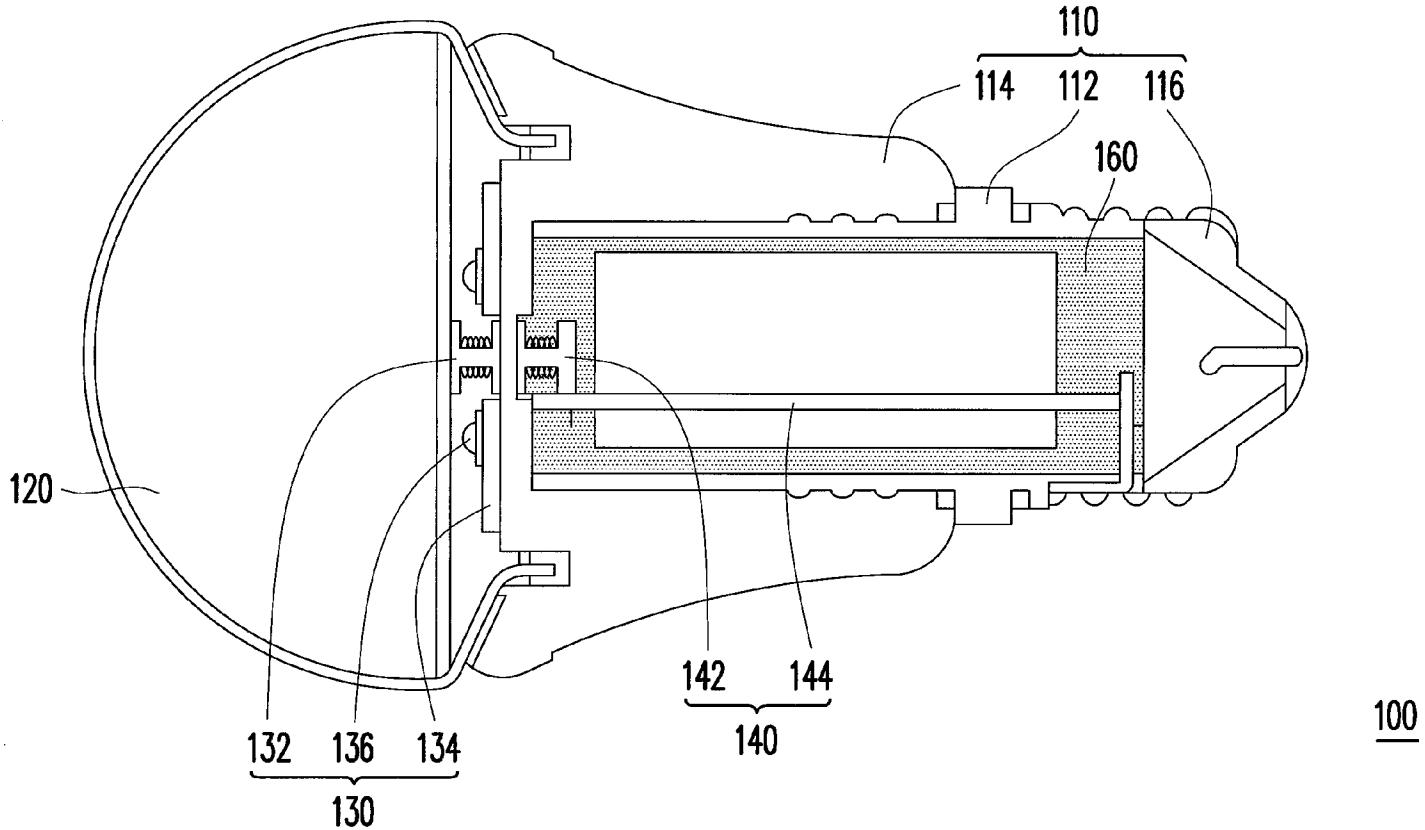
FIG. 4 is a front view of FIG. 3.

FIG. 2 is a schematic exploded view illustrating an illuminating device according to an embodiment of the invention. FIG. 3 is a cross-sectional view in three-dimension illustrating the illuminating device of FIG. 2 after assembly, and FIG. 4 is a front view of FIG. 3. Referring to FIGS. 2, 3 and 4 together, an illuminating device 100 of the embodiment includes a lampshade 110, a capper 120, a light source circuit board 130 and a power circuit board 140. The lampshade 110 has a top surface 110*a* and an accommodating space 110*b*, the capper 120 is telescoped on the lampshade 110, and the top surface 110*a* of the lampshade 110 is located in the capper 120. The light source circuit board 130 is disposed at the top surface 110*a*, having a first inductance coil 132. The power circuit board 140 is disposed in the accommodating space 110*b*, having a second inductance coil 142, wherein the first inductance coil 132 and the second inductance coil 142 are disposed adjacent to each other and spaced apart by a distance d. When the power circuit board 140 is powered, electric current flows through the second inductance coil 142, and power generated by induced current from the first inductance coil 132 and the second inductance coil 142 in the light source circuit board 130 is provided to the illuminating device 100 for light-emitting.

Specifically, the lampshade 110 includes a covering piece 112, a radiator 114 and a screw base 116. The covering piece 112 has the accommodating space 110*b* for accommodating the power circuit board 140. The radiator 114 and the screw base 116 are respectively telescoped on two ends of the covering piece 112. The radiator 114 is located at one end of the covering piece 112 relatively closer to the lampshade 120. The screw base 116 is located at one end of the covering piece 112 relatively far from the lampshade 120. That is, the top surface 110*a* is disposed on the radiator 114. It should be noted that, the illuminating device 100 of the present embodiment emits light by using power generated by induced current from the first inductance coil 132 and the second inductance coil 142, instead of using power from a connecting wire between the light source circuit board 130 and the power circuit board 140. Accordingly, the top surface 110*a* is a flat surface without any apertures. Further, it is not necessary to have apertures disposed on the covering piece 112 or the radiator 114 for the connecting wire or the connector to pass through. Compared with the conventional illuminating device, the covering piece 112 and the radiator 114 of the present embodiment may maintain integrity on external appearance.

Accordingly, the light source circuit board 130 includes a first circuit board 134, a plurality of light sources 136 and the first inductance coil 132, the first circuit board 134 is disposed at the top surface 110*a*, and the first circuit board 134 has a first surface 134*a* relatively far from the top surface 110*a*. The light sources 136 and the first inductance coil 132 are disposed on the first surface 134*a*, and the first inductance coil 132 is electrically connected to the light sources 136 through the first circuit board 134. The first inductance coil 132 includes a magnetic core and a coil surrounding outer periphery of the magnetic core. This is comprehensible to those of ordinary skills in the art, thus relevant description and drawings are omitted herein. In the present embodiment, the first inductance coil 132 is fixed on the first circuit 134 by adapting surface mount technology. The light sources 136 are LEDs. However, method of fixing the first inductance coil 132 on the first circuit 134 and type of the light sources 136 are not limited by the examples described in the present embodiment.

The power circuit board 140 includes a second circuit board 144 and the second inductance coil 142 disposed on the second circuit board 144, and the second inductance coil 142 is electrically connected to the second circuit board 144. Similarly, structure of the second inductance coil 142 is substantially the same as structure of the first inductance coil 132, which is also composed by a magnetic core and a coil surrounding outer periphery of the magnetic core. The differences between the second inductance coil 142 and the first inductance coil 132 may be shape of the magnetic core and turn number of the coil. Since it is comprehensible to those of ordinary skills in the art, thus relevant description and drawings are also omitted herein. The second inductance coil 142 of the present embodiment is a dual inline package component, however, the invention is not limited thereto. Of course, the power circuit board 140 may further include a plurality of electronic devices disposed on the second circuit board 144. However, since these electronic devices belong to prior art, which may be selectively used by those of ordinary skills in the art based on the requirements, the description thereof is omitted herein.

In view of above, the first inductance coil 132 and the second inductance coil 142 are respectively located at opposite sides of the top surface 110*a* and spaced apart according to the thickness of a top portion 114*a* (in which the top surface 110*a* is disposed on the top portion 114*a*) of the radiator 114, namely, a distance d. In other words, the first inductance coil 132 and the second inductance coil 142 are not physically contacted. In order to fix the relative locations of the radiator 114 and the second inductance coil 142, the top portion 114*a* of the radiator 114 further includes a notch 114*b*, and the second inductance coil 142 is inserted into the notch 114*b*. It should be noted that, axial of the first inductance coil 132 and axial of the second inductance coil 142 are remained in the same direction, in order to form a preferable field pattern of magnetic field. Furthermore, axial directions A of the first inductance coil 132 and the second inductance coil 142 are parallel to normal direction N of the top surface 110*a*.

When AC power is provided to the power circuit board 140, electric current is flowed from the second circuit board 144 through the second inductance coil 142, in which AC power allows the second inductance coil 142 to generate a constantly-changing magnetic field. The first inductance coil 132 is coupled to the constantly-changing magnetic field. In this case, magnetic flux of the first inductance coil 132 may also be changed constantly, thereby generating an induced electromotive force. Electric current is generated since the first inductance coil 132 is connected to the light sources 136 (load). Once electric current is flowed through the light sources 136, the light sources 136 start to emit light.

Particularly, in the illuminating device 100 of the present embodiment, power generated by induced current from the first inductance coil 132 and the second inductance coil 142 is provided to the light sources 136 for light-emitting. Therefore, the power circuit board 140 and the light source circuit board 130 are electrically connected without using any wires between the power circuit board 140 and the light source circuit board 130. As a result, it is not necessary to have apertures disposed on the top portion 114*a* of the radiator 114 located between the light source circuit board 130 and the power circuit board 140 for wires to pass through. Accordingly, it is also not necessary to have apertures disposed on inclined portion of the covering piece 112 and the radiator 114 for wires to pass through, such that the covering piece 112 and the radiator 114 may maintain integrity on external appearance.

In order to provide stable electric current to the light sources 136, a diode 138 may be disposed on the first circuit board 134, and the diode 138 may be electrically connected between the first inductance coil 132 and the light sources 136. Electric current outputted from the first inductance coil 132 is provided to the light sources 136 after being rectified by the diode 138. In addition, in order to maintain a preferable light-emitting effect of the light sources 136 disposed on the first circuit board 134, the illuminating device 100 may further include a radiating pad 150 disposed between the light source circuit board 130 and the top surface 110*a* of the lampshade 110. A radiating path is provided to the light source circuit board 130 by the radiating pad 150, such that the light source circuit board 130 may have quicker heat dissipation.

According to the same concept, in order to extend lifetime of the power source circuit 140 by quickly removing heat generated by the power source circuit 140 during power on, the illuminating device 100 may further include a radiating fluid 160, sealed in the accommodating space 110*b* (as shown in FIG. 4). The radiating fluid 160 helps the power source circuit 140 in heat removal. In addition, the illuminating device 100 may further include a first rubber ring 170, disposed between the radiator 114 and the covering piece 112. Moreover, the illuminating device 100 may further include a second rubber ring 180, disposed between the covering piece 112 and the screw base 116. Wherein the first rubber ring 170 and the second rubber ring 180 may be used at the same time or one at a time. With disposition of the first rubber ring 170 and the second rubber ring 180, not only the radiator 114, the covering piece 112 and screw base 116 may be closely combined, leaking of the radiating fluid 160 may also be prevented, such that the radiating fluid 160 may be sealed in the accommodating space 110*b*.

Figure 5A:
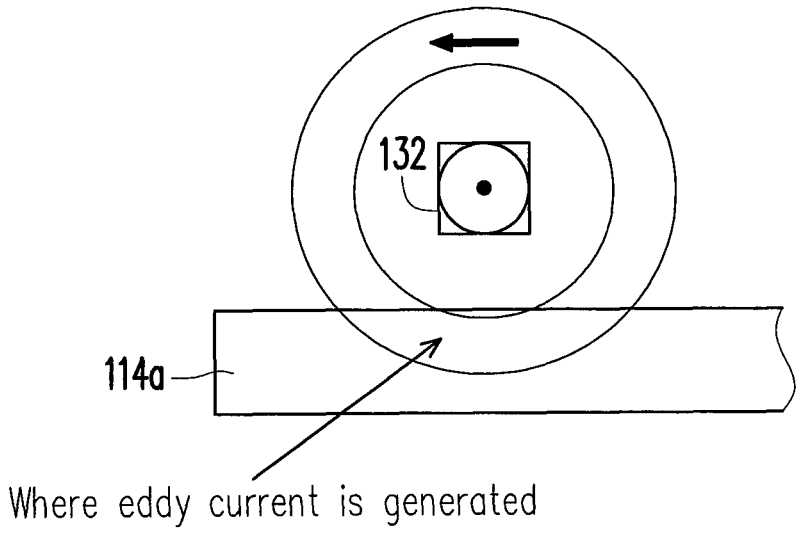
FIG. 5A is a schematic view illustrating that eddy current is generated in a top portion of the radiator when a flux field directional component is not disposed thereto.
Figure 5B:
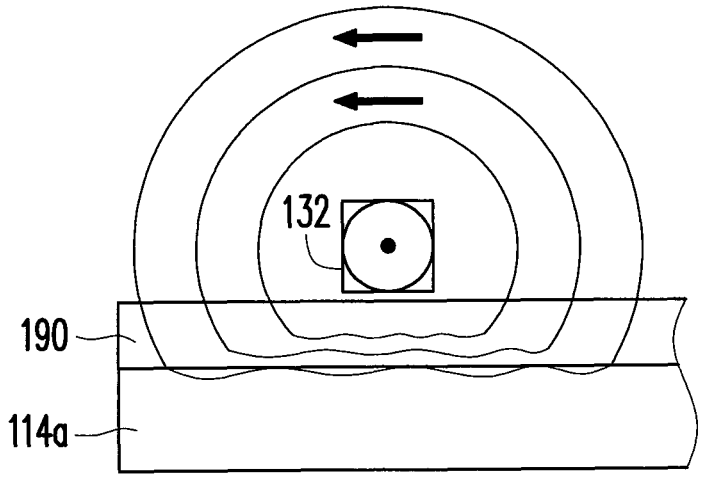
FIG. 5B is a schematic view illustrating that eddy current is not generated in a top portion of the radiator when a flux field directional component is disposed thereto.

Particularly, in the illuminating device 100 of the present embodiment, a flux field directional component 190 may be disposed between the light source circuit board 130 and the top surface 110*a* of the radiator 114. The flux field directional component 190, for example, may be a plate-shape. With disposition of the flux field directional component 190, eddy current formed in the top portion 114*a* of the radiator 114 (which is manufactured by metals) by constantly-changing magnetic field of the first inductance coil 132 may be reduced. Referring to FIG. 5A (eddy current is generated in a top portion 114*a* of the radiator 114 when a flux field directional component 190 is not disposed thereto) and FIG. 5B (eddy current is not generated in a top portion 114*a* of the radiator 114 when a flux field directional component 190 is disposed thereto) for more detail. As a result, heat generated by eddy current and accumulated in the radiator 114 may be reduced.

In the case where no other variable factors are changed, brightness of the illuminating device 100 may be altered by adjusting a distance d between the first inductance coil 132 and the second inductance coil 142. This is because that, magnetic field strength is altered by altering the distance d between the first inductance coil 132 and the second inductance coil 142. Therefore, the strength of the induced current is also affected, thereby affecting brightness of the illuminating device 100. For example, by thickening the thickness of the top portion 114*a* of the radiator 114, the distance d between the first inductance coil 132 and the second inductance coil 142 may be extended to alter the field pattern of magnetic field. Brightness of the illuminating device 100 is darker since the electric current is affected and became smaller. On the contrary, by shortening the distance d between the first inductance coil 132 and the second inductance coil 142, brightness of the illuminating device 100 is brighter since the electric current is affected and became larger.

Based on the above, in the illuminating device of the invention, the inductance coils on the power circuit board and the light source circuit board are used to generate induced current for providing power to the light sources of the light source circuit board to emit light. Compared with conventional illuminating device, since a connecting wire or a connector is used to electrically connected the light source circuit board and the power circuit board, apertures on the lampshade are required for the wires to pass through. In the illuminating device of the invention, since it is not necessary to have apertures disposed on the covering piece and the radiator for wires to pass through, integrity on external appearance thereof may be maintained.

Further, by filling the radiating fluid into the covering piece, disposing the rubber rings between the covering piece and the radiator and between the covering piece and the screw base, not only the radiator, the covering piece and the screw base may be closely combined, the radiating fluid may also be prevent from leaking outside of the lampshade. In addition, since that quickly removing heat of the power circuit board is enabled by the radiating fluid, the lifetime of the power circuit board may also be extended.

Moreover, the flux field directional component is used in the illuminating device of the invention to prevent eddy current from generating. Therefore, heat accumulation generated by eddy current in the top portion of the radiator is prevented to ensure a preferable effect of heat removal and further extend the lifetime of the illuminating device.

Although the invention has been described with reference to the above embodiments, it is apparent to one of the ordinary skill in the art that modifications to the described embodiments may be made without departing from the spirit of the invention. Accordingly, the scope of the invention will be defined by the attached claims not by the above detailed descriptions.

What is claimed is:

1. An illuminating device, comprising:

a lampshade, having a top surface and an accommodating space;

a capper, telescoped on the lampshade, and the top surface is located in the capper;

a light source circuit board, disposed on the top surface, having a first inductance coil; and a power circuit board, disposed in the accommodating space, having a second inductance coil, wherein the first inductance coil and the second inductance coil are disposed adjacent to each other and spaced apart by a distance.

2. The illuminating device of claim 1, wherein the lampshade comprises:

a covering piece, having the accommodating space;

a radiator, disposed on one end of the covering piece relatively closer to the lampshade, wherein the power circuit board is accommodated in the covering piece, and the top surface is disposed on the radiator; and a screw base, disposed on one end of the covering piece relatively far from the lampshade.

3. The illuminating device of claim 2, further comprising a first rubber ring, disposed between the radiator and the covering piece.

4. The illuminating device of claim 2, further comprising a second rubber ring, disposed between the covering piece and the screw base.

5. The illuminating device of claim 1, wherein the light source circuit board comprises:

a first circuit board, disposed on the top surface, having a first surface, and the first surface is relatively far from the top surface;

a plurality of light sources, disposed on the first surface; and the first inductance coil, disposed on the first surface, and the first inductance coil is electrically connected to the plurality of light sources through the first circuit board.

6. The illuminating device of claim 5, wherein the first inductance coil is fixed on the first circuit board using surface mounted technology.

7. The illuminating device of claim 5, wherein the plurality of light sources are LEDs.

8. The illuminating device of claim 5, wherein the light source circuit board further comprises a diode, disposed on the first circuit board, the diode is electrically connected between the first inductance coil and the plurality of light sources.

9. The illuminating device of claim 1, wherein the power circuit board comprises:

a second circuit board; and the second inductance coil, disposed on the second circuit board, the second inductance coil is electrically connected to the second circuit board, and the first inductance coil and the second inductance coil are respectively located at two opposite sides of the top surface.

10. The illuminating device of claim 9, wherein the second inductance coil is a dual inline packages component.

11. The illuminating device of claim 1, wherein axial directions of the first inductance coil and the second inductance coil are parallel to normal direction of the top surface.

12. The illuminating device of claim 1, further comprising a flux field directional component, disposed between the light source circuit board and the top surface of the lampshade.

13. The illuminating device of claim 12, further comprising a radiating pad, disposed between the flux field directional component and the top surface.

14. The illuminating device of claim 1, further comprising a radiating pad, disposed between the light source circuit board and the top surface of the lampshade.

15. The illuminating device of claim 1, further comprising a radiating fluid, disposed in the accommodating space.

16. The illuminating device of claim 1, wherein brightness of the illuminating device varies with adjustment of a distance between the first inductance coil and the second inductance coil.

* * * * *